US005348809A

United States Patent [19]

Oyagi et al.

[11] Patent Number: 5,348,809

[45] Date of Patent: Sep. 20, 1994

[54] SHEET STEEL EASY OPEN CAN LID SUPERIOR IN CAN OPENABILITY AND NOT REQUIRING REPAIR COATING OF INNER AND OUTER SURFACES

[75] Inventors: Yashichi Oyagi, Futtsu; Kiyonori Nakamura; Keiji Taniuchi, both of Tokyo, all of Japan

[73] Assignee: Nippon Steel Corporation, Tokyo, Japan

[21] Appl. No.: 971,797

[22] Filed: Nov. 5, 1992

[30] Foreign Application Priority Data

| | | | |
|---|---|---|---|
| Nov. 8, 1991 | [JP] | Japan | 3-293417 |
| Nov. 8, 1991 | [JP] | Japan | 3-293418 |
| Nov. 8, 1991 | [JP] | Japan | 3-293419 |
| Nov. 8, 1991 | [JP] | Japan | 3-293420 |

[51] Int. Cl.[5] ..... B65D 17/28; B21D 51/44

[52] U.S. Cl. ..... 428/622; 428/626; 428/43; 428/458; 220/266

[58] Field of Search ..... 428/571, 572, 626, 43, 428/458, 457, 622, 623; 220/266

[56] References Cited

U.S. PATENT DOCUMENTS

| | | | |
|---|---|---|---|
| 3,735,893 | 5/1973 | Gayner et al. | 220/270 |
| 3,753,847 | 8/1973 | Gayner et al. | 220/266 |
| 3,762,598 | 10/1973 | Gayner et al. | 220/273 |
| 3,765,561 | 10/1973 | Hekal et al. | 220/270 |
| 3,857,973 | 12/1974 | McKee et al. | 220/266 |
| 3,996,867 | 12/1976 | Taniuchi | 413/12 |
| 4,403,710 | 9/1983 | Hirota et al. | 220/270 |
| 4,428,494 | 1/1984 | Hirota et al. | 220/270 |
| 4,773,558 | 9/1988 | Taira et al. | 220/270 |
| 4,828,136 | 5/1989 | Kawahara et al. | 220/270 |
| 5,147,058 | 9/1992 | Secondé | 220/270 |

FOREIGN PATENT DOCUMENTS

| | | |
|---|---|---|
| 0425401 | 5/1991 | European Pat. Off. . |
| 3836858 | 5/1990 | Fed. Rep. of Germany . |
| 2269454 | 11/1975 | France . |
| 55-70434 | 5/1980 | Japan . |
| 57-175034 | 10/1982 | Japan . |

OTHER PUBLICATIONS

Database WPIL Week 8951, Derwent Publications, Ltd., London, GB; AN89-373385.

Database WPIL JP-A-1 278 340 (Kobe Steel) 8 Nov. 1989.

*Primary Examiner*—John Zimmerman

*Attorney, Agent, or Firm*—Kenyon & Kenyon

[57] ABSTRACT

A sheet steel easy open can lid made by a resin-laminated sheet steel and not requiring repair coating of the inner and outer surfaces thereof, wherein use is made of a sheet steel laminated with a resin such as polyester and a tear-along groove, having as its main constituent element at the peripheral edge of the opening piece a thin portion having the specified minimum thickness is formed by composite cold-forming. The part or substantially all of this can lid can be easily opened by hand.

8 Claims, 3 Drawing Sheets

SHEET STEEL EASY OPEN CAN LID SUPERIOR IN CAN OPENABILITY AND NOT REQUIRING REPAIR COATING OF INNER AND OUTER SURFACES

BACKGROUND OF THE INVENTION

1. Field of the Invention

The present invention relates to a metal container lid, more particularly a sheet steel (or steel sheet) easy open can lid which enables part or substantially all of the can lid to be easily opened by hand, and is used for beverage cans, general food cans, and a wide range of other applications.

2. Description of the Related Art

Two types of easy open can lids enabling part or substantially all surface of the container lid to be easily opened by hand have been commercialized: the "tear off" type where a tab and an opening piece are torn off to separate the lid from the can body and the "stay on" type where the tab and the opening piece both remain affixed to the can body even after opening. In both types, almost all the easy open can lids are made of sheet aluminum due to reasons of manufacturing technology. Sheet steel is used at present for only some limited applications.

In a typical example of the prior art, coated aluminum or sheet steel is used as the material and is punched to the basic lid shape, then the lid body is placed on a flat lower mold half and a sharp blade having the required contour shape is pressed from the top surface so that the cutting edge bites into the lid body, thereby forming the shape of the opening piece surrounded by a V-sectional shaped tear-along groove (FIG. 6).

Steel materials themselves have a basic feature of a high strength. Forming a tear-along groove to an extent enabling easy opening by the hand requires strong pressure by the sharp blade corresponding to about one-half to two-thirds of the thickness of the sheet before processing. When the tear-along groove is too shallow in depth, the can openability is defective, while when too deep, an insufficient impact strength with respect to, for example, external shock are caused, and therefore, considerable accuracy has been considered necessary.

Therefore, considerable precision is required of the processing tools as well, but in the case of sheet steel requiring a strong pressure of the sharp blade, there was the defect that the tool life could not be maintained. Further, to ensure corrosion resistance with respect to the contents or to prevent rusting on the outside surface, repair coating of the portions of the metal surface exposed by the processing of the tear-along grooves was considered necessary.

As a means for extending the tool life, as shown in, for example, Japanese Unexamined Patent Publication Nos. 55-70434, and No. 57-175034, the method has been proposed of forming the tear-along grooves by composite cold forming. This known method was based upon the use of sheet steel and was an effective means of extending tool life, but there was the defect that since the sectional structure of the tear-along groove was complicated, with the normal spray coating method, the coating material would not reach all portions in the tear-along groove, and therefore, sufficient corrosion resistance could not be obtained, even with repair coating.

In the prior art using a sharp blade, aluminum was considered preferable as the material due to its properties, and sheet steel was used as a material only for extremely limited applications, as mentioned above. The reasons were mainly that (1) the resistance of sheet steel to strong pressure by a sharp blade is strong, and therefore, the life of the processing tools is extremely short, (2) the coating film on the surface of the sheet steel is broken by the processing and repair coating is required at the entire area of the tear-along groove or the tab calking portion, (3) scratches are sometimes generated in a coating film on the surface, which should be an inner surface of a can, during the processing, etc.

On the other hand, in recent years, there has been rising awareness of the global environment and to deal with this it is considered that an orientation toward recyclable products is necessary. In the area of metal cans, so-called "mono-metal cans" where the can body and the can lid are formed by the same material are being viewed with importance.

At the present time, the majority of metal cans use sheet steel as the material for the can bodies. There is a strong desire for some measure which will enable manufacture, with a good productivity, of sheet steel easy open can lids superior in can openability, not requiring repair coating of the inner or outer surfaces, and superior in corrosion resistance. Of course, sheet steel itself is superior in economy and by making both the can body and can lid out of sheet steel, the product can be expected to be more superior in economy and easier to recycle as a resource.

SUMMARY OF THE INVENTION

The objects of the present invention are to eliminate the above-mentioned problems in the prior art and to provide a sheet steel easy open can lid which enables part or substantially all of the can lid to be easily opened by hand.

Other objects and advantages of the present invention will be apparent from the description hereinbelow.

In accordance with the present invention, there is provided a sheet steel easy open can lid not requiring repair coating of the inner and outer surfaces, wherein a resin-laminated sheet steel is used as a substrate and a tear-along groove at the peripheral edge of the opening piece is formed by composite cold-forming.

In accordance with the first preferable aspect of the present invention, there is provided an easy open can lid made by a resin-laminated sheet steel and not requiring repair coating of the inner and outer surfaces, characterized in that use is made of resin-laminated (or coated) sheet steel having an elongation at break of 50% or more, a tensile modulus of at least 60 kg/mm$^2$, and resin coatings having a thickness of 10 to 80 $\mu$m at the two sides and in that a tear-along groove, having as its main constituent element at the peripheral edge of the opening piece a thin portion of a minimum thickness of $\frac{1}{2}$ or less of the pre-processing thickness (i.e., thickness of the substrate or the starting basic sheet steel) is formed by composite extrusion.

In accordance with the second preferable aspect of the present invention, there is provided:

(1) steel sheet easy open can lid superior in can openability and not requiring repair coating of the inner and outer surfaces, characterized in that use is made of a surface-treated sheet steel having a hardness ($H_{R30T}$) of 54 to 68 and an elongation of 10 to 40% on the two surfaces of which is laminated a polyester resin having a glass transition temperature of at least 50° C., a crystalline melting point of at least 210° C., and an orientation of 0.160 or less and in that a tear-along groove, having as its main constituent element at the peripheral edge of the opening piece a thin portion of a thinnest thickness of ½ or less of the pre-processing thickness, is formed by composite extrusion; and (2) steel sheet easy open can lid superior in can openability and not requiring repair coating of the inner or outer surfaces as set forth in paragraph (1), characterized by having under the laminated resin film a polyester resin layer having a glass transition temperature of 50° C. or less.

In accordance with the third preferable aspect of the present invention, there is provided a steel sheet easy open can lid superior in can openability, having a suitable processability, and not requiring repair coating of the inner and outer surfaces, characterized in that a polyester resin having a surface orientation of 0.160 or less is laminated to a thickness ($f_0$) of 0.010 to 0.080 mm on the two surfaces of sheet steel of a thickness $t_0$ of 0.150 to 0.300 mm and composite extrusion is used to form a tear-along groove, having as its main constituent element at the peripheral edge of the opening piece a thin portion, wherein the processing is performed so as to satisfy the relationships of $$t_0/10 \leqq t_{min} \leqq t_0/2$$

where, $t_{min}$.: thinnest thickness inside tear-along groove and $$4.0 \leqq f_0 \times (t_{min}/t_0)$$

In accordance with the fourth preferable aspect of the present invention, there is provided a sheet steel easy open can lid superior in can openability and not requiring repair coating of the inner and outer surfaces, characterized by having as a substrate a surface treated sheet steel having as a plating layer one or more metals of Sn, Cr, Ni, Al, and Zn and having on its two surfaces a polyester resin film of a density of desirably at least 1,350 g/cm$^3$ and a surface orientation of 0.160 or less which is firmly and closely adhered to the plating layer through a chromate film and by having a tear-along groove, having as its main constituent element at the peripheral edge of the opening piece a thin portion of a thinnest thickness of ½ or less of the pre-processing thickness, formed by composite cold forming.

BRIEF DESCRIPTION OF THE DRAWINGS

The present invention will be better understood from the description set forth below with reference to the accompanying drawings, wherein:

FIG. 5(*b*) is a longitudinal sectional view showing the state of forming a tear-along groove from the state of (*a*)

DESCRIPTION OF THE PREFERRED EMBODIMENTS

Figure 1:
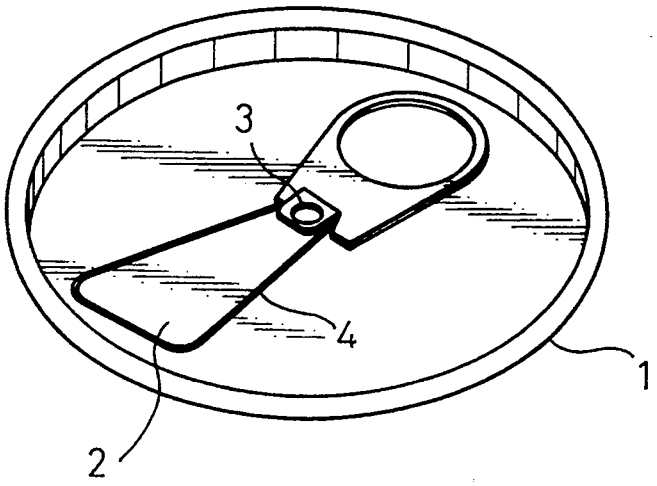
FIG. 1 is a perspective view of a can lid having a tear off type opening piece formed according to the present invention.

The present invention will be explained in detail below.

According to the first preferable aspect of the present invention, there must be a resin film of an elongation at break of 300% or less, a tensile modulus of at least 60 kg/mm$^2$, and a thickness of 10 to 80 μm at the two surfaces of the surface-treated sheet steel. The resin film is an important element. It has superior processability and when forming the tear-along groove composite extrusion, closely adheres to and follows the material, and therefore, covers the material completely even after processing and therefore requires no repair coating as had been necessary in the past. Further, to prevent the resin alone from remaining locally (feathering) at the cut opening of the tear-along groove at the time of can opening and detracting from the impression given by the outside appearance, it is necessary to use a specific resin.

As the physical properties of the resin film required by the present invention, it is important that the elongation at break be in the range of 50% or more, preferably 50% to 300%. When the elongation at break is less than 50%, numerous defects occur in the resin film due to insufficient elongation for the formation of the thin portion at the time of composite extrusion, and therefore, this is not desirable. On the other hand, when the elongation at break of the resin film is more than 300%, problems occur at the time of can opening. That is, it is necessary that the laminated resin film break along the tear-along groove at the time of can opening. When the elongation is too high, the film will stretch long until breaking and result in feathering, so it is necessary to keep the elongation rate to under 300%. But this problem is overcome by heating the polyester resin coating after composite cold-forming. The polyester resin easily crystallizes by heating above about 100° C. and the elongation of the resin itself reduces rapidly to under 300%. The elongation characteristic able to satisfy both the processability and feathering resistance is in the range of 50% or more, more preferably in the range of 70% or more.

The elongation characteristic of the laminated resin film is measured by a method based on JIS (i.e., Japanese Industrial Standard) C2318 using resin film peeled from the material.

The second important point as the physical properties of the resin film is that the resin film must have a tensile modulus of at least 60 kg/mm$^2$, more preferably a tensile modulus of at least 90 kg/mm$^2$. The tensile modulus spoken of here is the ratio of the tensile stress within the tensile elastic limit and the strain corresponding to the same. When there is no straight line portion in the stress-strain curve in the tensile test, this is found from the inclination of the tangent at the starting point of deformation. This modulus shows the degree of hardness of the resin itself. The larger the modulus, the stronger the stiffness. By maintaining a small difference in strength with the sheet steel material, a superior processability may be expected to be imparted. By using a resin film with a tensile modulus of at least 60 kg/mm$^2$, more preferably at least 90 kg/mm$^2$, it is possible to effectively prevent shaving and buildup of the resin film at the mold R corners and flaws at the friction portions with the mold. This prevents occurrence of film defects during the processing and opens the way to elimination of repair coating of the inner and outer surfaces.

The thickness of the film laminated in the present invention is within the range of 10 to 80 μm, but when considering, for example, the stability, economy, it is particularly effective when it is in the range of 16 to 60 μm. When the thickness is too thin, it is self evident that processing defects will easily occur, but this does not mean it should just be made thicker. When the film is more than 60 μm thick, in particular more than 80 μm, the corrosion resistance after the processing becomes better, but when the tear-along groove is broken (when the can is opened), the film will stretch long until breaking and easily result in feathering, and therefore, it is disadvantageous to use an overly thick film.

As specific examples of the resin film used, mention may be made of biaxially oriented polyester, biaxially oriented nylon, non-oriented polypropylene, biaxially oriented polypropylene, polyethylene, and other films. As the method of lamination, film may be laminated on the two sides of the sheet steel by adhering the film itself by heat or by coating a thermosetting adhesive.

When using the surface-treated sheet steel having the resin film to shape an easy open can lid, the processing method is extremely important. That is, it is not desirable to form the tear-along groove by the method of pressing by a sharp blade, a representative conventional art, since the laminate film is also broken and repair coating after shaping is required. To form a tear-along groove which guarantees easy can opening and does not break the resin film, it is important to form the thin portion by elongating the material as a whole by elongation deformation so as to form a thin portion with a smooth change in thickness. By forming a tear-along groove having as a main constituent element at the peripheral edge of the opening piece a thin portion having a thinnest thickness of ½ or less of that before the processing, it becomes possible to obtain a sheet steel easy open can lid which is superior in can openability and which does not require repair coating at the inner and outer surfaces.

The specific processing method is the same as the case of the below-mentioned third preferable aspect of the present invention.

The sheet steel used in the second preferable aspect of the present invention must have a hardness ($H_{R30T}$) of 54 to 68 and an elongation of 10 to 40%. In this aspect of the present invention, the tear-along groove, which governs the can openability, is formed by composite extrusion, explained later, but basically the thin portion is made using the elongation of the material and the can is opened by tearing the thinnest portion. Therefore, to obtain a more easily openable lid, it is important to make the thinnest portion thinner. Thus, the material has to have a superior elongation characteristic.

On the other hand, the lid itself forms a part of the can body. A strong material is required to maintain the can strength. In particular, it is considered necessary to have a strength sufficient to withstand internal pressure in the case of a can under internal pressure, such as a beer can or a carbonated beverage can.

In general, when trying to raise the strength of a material, it is well known that the elongation characteristic falls. The range where the best balance of the can strength, can openability (reduction of thickness of thinnest portion), and economy (sheet thickness) is obtained is a hardness ($H_{R30T}$) of 54 to 68 and an elongation of 10 to 40%. Materials with high hardnesses and large elongations give the best economy.

Sheet steel having such mechanical properties is used as the substrate which is then surface treated, but the type of plating is not critical. Use may be made of surface-treated sheet steel plated with one or more of Sn, Cr, Ni, Al, and Zn and having a thickness of from 0.15 to 0.30 mm.

At the outermost surface of the plated sheet steel, it is desirable that a chromate film be provided to ensure the close adhesion of the polyester resin film. A chrome oxide hydrate film alone or a film having a metal chrome underlayer is effective. It is important that the chrome oxide hydrate film cover the entire surface uniformly.

The two surfaces of the surface-treated sheet steel must have a polyester film of a glass transition temperature of at least 50° C., a crystalline melting point of at least 210° C., and a surface orientation of 0.160 or less. The polyester resin film is an important element. It has superior processability and when forming the tear-along groove by composite cold-forming, closely adheres to and follows the material, so covers the material completely even after processing and therefore requires no repair coating as had been necessary in the past.

The steel sheet used in the third preferable aspect of the present invention has a thickness $t_0$ in the range of 0.150 to 0.300 mm, a hardness ($H_{R30T}$) of 54 to 68, and an elongation of about 10 to 40%. The characteristics such as the thickness, hardness, elongation are selected in accordance with the can strength required, but the biggest factor in can strength is the sheet thickness.

In the case of cans under internal pressure, such as beer and carbonated beverage cans, sheet steel having a thickness of 0.18 to 0.20 mm is used, while in the case of cans not under internal pressure, sheet steel having a thickness of 0.18 to 0.20 mm is used, so is made even thinner.

The surface of this sheet steel is plated with one or more of Sn, Cr, Ni, Al, and Zn and is laminated with a polyester resin film superior in close adhesion, processability, and corrosion resistance through a chromate treatment film so as to eliminate the need for repair coating after processing. As the polyester resin film, use is made of one having a surface orientation of less than 0.160 and a thickness $f_0$ of 0.010 to 0.080.

The polyester resin to be used in the present invention means a linear thermoplastic polyester obtainable by condensation polymerization of a dicarboxylic acid and a diol and is typically represented by polyethylene terephthalate.

As the dicarboxylic acid component, mention may be made of, for example, terephthalate acid, isophthalic acid, phthalic acid, adipic acid, sebacic acid, azelaic acid, 2,6-naphthalene dicarboxylic acid, decane dicarboxylic acid, dodecane dicarboxylic acid, cyclohexane dicarboxylic acid. These compounds may be used alone or in any mixtures thereof. As the diol component, mention may be made of, for example, ethylene glycol, butane diol, decane diol, hexane diol, cyclohexane diol, neopentyl glycol. These compounds may be used alone or in any mixture thereof. Copolymers of two or more dicarboxylic acid components and diol components or copolymers of diethylene glycol, triethylene glycol, and other monomers and polymers may be used as well. If necessary, plasticizers, antioxidants, heat stabilizers, inorganic particles, dyes, organic lubricants, and other conventional additives may be used in the present invention.

The polyester resin thus obtained is formed into a film in the molten state by a T-die and is biaxially oriented from the amorphous state to thereby form a film with a superior balance of performance in the heat resistance, processability, and barrier property.

As the properties of the laminate film required for the present invention, it is desirable that the density be at least 1.350 g/cm$^3$ after the preparation of a can. When the density is less than 1.350 g/cm$^3$, the crystallization is insufficient and problems occur in the heat resistance, barrier property, and other facets of performance.

Further, as another physical property, it is important that the surface orientation be in the range of at most 0.160, more preferably in the range of at most 0.140. The surface orientation (N) used herein is indicated by the following formula:

$$N=(N_x+N_y)/2-N_z$$

where, $N_x$: refractive index in lateral direction, $N_y$: refractive index in longitudinal direction, $N_z$: refractive index in thickness direction.

Polyester film inherently has superior properties of mechanical strength, heat resistance, and gas permeability when the orientation is large, but in applications like the present invention where composite processing is performed, there is an optimal range in view of, for example, the processability, can openability, heat resistance after processing. When the orientation is less than 0.030, the heat resistance, gas permeability, etc., of the resin itself tend to be inferior, but this can be recovered by heat treatment after processing to increase the degree of crystallinity. But these problems are overcome by hearing the polyester resin coating after composite cold-flowing. The polyester resin easily crystallizes by heating above about 100° C. and gains good heat resistance, permeability of the resin itself. On the other hand, when the surface orientation is more than 0.160, there are problems in the processability, can openability, and heat resistance after processing. In particular, when opening the can, it is necessary to break the laminated plastic film along with tear-along groove. When the surface orientation is too high, there is a tendency for feathering. The preferable surface orientation is in the range of at most 0.140.

The thickness $f_0$ of the laminated film used in the second and below-mentioned fourth preferable aspects of the present invention is in the range of 5 to 100 μm, preferably 10 to 80 μm, but when, for example, considering the stability, economy of the performance, use is most often made of the laminated film having a thickness of 12 to 40 μm. As the method of lamination, the film itself may be adhered by heat to the two surfaces of the above-mentioned sheet steel or a thermosetting adhesive may be applied and then the film laminated.

When using the surface-treated sheet steel having the polyester resin film to shape an easy open can lid, the processing method is extremely important. That is, it is not desirable to shape the tear-along groove by the method of pressing by a sharp blade, a representative conventional art, since the laminate film is also broken and repair coating after shaping is required.

To form a tear-along groove which guarantees easy can opening and does not break the polyester resin film, it is important to form the thin portion by elongating the material as a whole by elongation deformation and not applying a large shearing stress locally. By using such a processing method to form a tear-along groove having as a main constituent element at the peripheral edge of the opening piece a thin portion having a thinnest thickness of ½ or less of that before the processing, it becomes possible to obtain a sheet steel easy open can lid which is superior in can opening ability and which does not require repair coating at the inner and outer surfaces.

As the specific processing method, use is made of upper and lower mold halves substantially corresponding to the opening piece in shape and dimensions so as to press key portions of the lid body and thereby extrude upward or downward the portion corresponding to the shade of the opening piece. At this time, the peripheral edge of the opening piece is drawn between the upper and lower mold halves to reach the desired thickness and form a thin portion with a smooth change of thickness. In another case, the thickness of the thinnest portion is formed by press with the gentle slope of upper and lower mold. The thickness of the thinnest portion must be less than ½ of the thickness before processing in view of the can openability.

The tearing position at the time of can opening is determined by this processing, but to improve the can openability and obtained a desirable shape of the opening after can opening, the opening piece portion extruded upward or downward is pushed back to the level before the processing. At this time, the thin portion having the smooth change in thickness which was formed by the extrusion is bent to a V-sectional shape to form the thin tear-along groove. The depth of the tear-along groove, the thickness of the thinnest portion, etc. can be made the values desired for the processability of the material by suitably setting the processing conditions. The processing conditions are selected in accordance with the processability of the sheet steel material and the laminate film.

In this series of processing steps, the polyester resin film is evenly drawn along with the material and no processing defects occur, and therefore, there is no need for repair coating after processing and excellent corrosion resistance can be ensured. Further, since the processing is based on pressing to extrude out or push back the sheet, there is almost none of the problem of tool life as seen in the method of pressing by a shard blade and therefore a superior productivity can be ensured.

As the physical property of the resin film required in the second preferable aspect of the present invention, it is first of all important that the glass transition temperature be at least 50° C. As is well known, the glass transition temperature is the temperature at which a resin changes to a rubbery elastic state from the glass state. Plastics with a low glass transition temperature are superior in processability at room temperature, but have defects such as being soft and easily blemished or building up in, for example, the mold, and therefore, cause problems in the case of industrial scale mass production. Therefore, it is important that the resin film have a glass transition temperature of at least 50° C., more preferably at least 60° C.

When hoping for extremely good performance, it is effective to use a two-layer construction of film comprised of a layer facing the sheet steel which has a glass transition temperature of under 50° C. and thus is superior in close adhesion and processability and a layer facing outward which has a glass transition temperature of 50° C. or more and thus is free from flaws and build-up in the mold.

A second reason for making the glass transition temperature 50° C. or more is the problem of resistance to feathering at the time of can opening. When tearing open the opening piece to open the can, a resin having a glass transition temperature of less than 50° C. suffers from noticeable pieces of broken film at the cut portion, which is unpleasant in terms of outer appearance.

Next, the reason for specifying the crystalline melting point of the resin is that, when the crystalline melting point is less than 210° C., the heat resistance of the polyester resin drops and there are notable restrictions on the conditions of the heat treatment required in the can-making process. The crystalline melting point used herein means the temperature where the maximum peak of the endothermic peaks appearing when raising the temperature at a heating rate of 5° C./min is shown by a differential scanning calorimeter.

The present invention is mainly characterized by optimization of the tear-along groove existing at the peripheral edge of the opening piece. It is possible to use the tear-off method where the tab and opening piece are torn-off from the can body and the stay-on tab method where the tab and opening piece remain affixed to the can body even after can opening.

To form a tear-along groove which guarantees easy can opening and does not break the polyester resin film obtained using the above-mentioned polyester resin, according to the third aspect of the present invention, the tear-along groove having as its main constituent element the thin portion formed by elongating the material as a whole by elongation deformation is formed at the peripheral edge of the opening piece, whereby it becomes possible to obtain a sheet steel easy open can lid superior in can openability and not requiring repair coating of the inner and outer surfaces.

To ensure a superior can openability, it is important that the thickness ($t_{min}$) of the thinnest portion in the tear-along groove be held within the range of $$t_0/10 \leqq t_{min} \leqq t_0/2$$

When just the can openability is to be improved, it is desirable that $t_{min}$ be made as thin as possible, but to maintain sufficient strength to withstand the impact of the can being dropped in, for example, a vending machine, there is a suitable $t_{min}$ and it is not desirable that it be less than $t_0/10$. The upper limit $t_0/2$ of $t_{min}$ is set in view of the can openability.

As the specific processing method, use is made of upper and lower mold halves substantially corresponding to the opening piece in shape and dimensions so as to press key portions of the lid body and thereby extrude the portion corresponding to the shape of the opening piece upward or downward. At this time, the peripheral edge of the opening piece is drawn between the upper and lower mold halves to reach the desired thickness and form a thin portion with a smooth change of thickness.

The tearing position at the time of can opening is determined by this processing, but to improve the can openability and obtain a desirable shape of the opening after can opening, the opening piece portion extruded upward or downward is pushed back to the level before the processing. At this time, the thin portion having the smooth change in thickness which was formed by the extrusion is bent to a V-sectional shape to form the thin tear-along groove. The depth of the tear-along groove, the thickness of the thinnest portion, for example, can be made the values desired for the processability of the material by suitably setting the processing conditions. The processing conditions are selected in accordance with the processability of the sheet steel material and the laminate film.

In this series of processing steps, the polyester resin film is evenly drawn along with the material, but too strong a processing invites film defects and makes repair coating after the processing necessary. To avoid repair processing after processing, it is also important that the processing mold be appropriate, but it is necessary in particular to set a suitable degree of processing. That is, it is important to set the processing conditions so that the following relationship is satisfied:

$$4.0 \leqq f_0 \times (t_{min}/t_0)$$

What this means is that when the polyester resin film remaining at the thinnest portion formed in the tear-along groove is 4 μm or more in thickness, no film defects causing practical problems occur and a superior corrosion resistance can be expected. For contents having particularly strong corrosiveness, it is desirable that film having a thickness of 8 to 10 μm remain.

As explained above, to ensure a suitable can strength (impact resistance), a good can opening ability, and corrosion resistance (not requiring repair), it is necessary to set a suitable degree of processing to satisfy the two equations:

$$t_0/10 \leqq t_{min} \leqq t_0/2$$

$$4.0 \leqq f_0 \times (t_{min}/t_0)$$

According to the present invention, since the processing is based on pressing to extrude or push back the material, there is almost none of the problem of tool life as seen in the method of pressing by a sharp blade and there is also no need for repair coating, therefore a superior productivity can be ensured.

The present invention is mainly characterized by optimization of the tear-along groove existing at the peripheral edge of the opening piece. It is possible to use the tear-off method where the tab and opening piece are torn off from the can body and the stay-on tab method where the tab and opening piece remain affixed to the can body even after can opening.

The sheet steel used in the fourth preferable aspect of the present invention is a surface-treated sheet steel plated with one or more of Sn, Cr, Ni, Al, and Zn and having a thickness of from 0.15 to 0.30 mm. Specifically, there are tin-plated sheet steel plated with 0.5 to 3.0 g/m$^2$ of tin, then treated chemically, nickel-plated sheet steel plated with 0.3 to 2.0 g/m$^2$ of nickel, then treated chemically, Sn/Ni plated sheet steel plated with 0.5 to 2.0 g/m$^2$ of Ni and 0.01 to 0.5 g/m$^2$ of Sn in the order of Ni and Sn, then treated chemically, and chrome-chromate treated sheet steel having 50 to 200 mg/m$^2$ of the metal Cr deposited and 5 to 30 mg/m$^2$ chrome oxide, known as TFS (Tin Free Steel).

In applications requiring a high degree of rust protection at the outer surface of the can, use is made of Zn plating of a deposition of about 0.5 to 10 g/m$^2$alone or combined with the above-mentioned platings. Further, if necessary, it is also possible to use electrically aluminum plated or molten aluminum plated sheet steel.

The outermost surface of these surface-treated sheet steels require the presence of a chromate treatment film for ensuring the air-tightness of the polyester resin film. A chrome oxide hydrate film alone or a film having metal chrome as its underlayer is effective. It is important that the chrome oxide hydrate film uniformly cover the surface as a whole.

The polyester resin coating has a density of desirably at least 1.350 g/m$^2$, and an orientation of at most 0.160 on the two surface of the surface treated steel sheet. The polyester resin film is an important element. It has superior processability and when forming the tear-along groove by composite cold-forming, closely adheres to and follows the material, and therefore, covers the material completely even after processing and therefore requires no repair coating as had been necessary in the past.

As mentioned above, the easy open can lid of the present invention is constructed by specifying the material and the processing method, that is, by adoption of a polyester resin film having a superior processability and a composite extrusion method not using a sharp blade. Therefore, according to the present invention, it is possible to completely eliminate the major problems in the prior art, i.e., the problem of processing tool life, the problem of the need for repair coating, and the unease over the corrosion resistance of the surface.

Once the sheet steel easy open can lid is put into practical use, a "monometal can" will become possible, and therefore, it will be possible to provide the market with a product suited for recycling and thereby alleviate the problem of global pollution.

Of course, sheet steel itself is superior in economy. By making both the can body and can lid out of sheet steel, the can may be expected to be more superior in economy and to be a more easily recycled resource.

EXAMPLES

The present invention will now be further illustrated by, but is by no means limited to, the following Examples.

EXAMPLE 1—1

The surface of a thin sheet steel having a thickness of 0.250 mm and a hardness ($H_{R30T}$) of 62 was tin plated electrically to a deposition of 2.8 g/m$^2$. The tin was heated and melted to give a surface with a mirror gloss, then electrolytic after-treatment was performed in a treatment bath consisting mainly of chromic acid to form a chromate film of metal chrome of 12 mg/m$^2$ and, on the top of the same, chrome oxide hydrate of 12 mg/m$^2$ (as Cr). This was rinsed and dried, then the sheet steel was heated and a polyester resin film having a thickness of 20 μm having a surface orientation of 0.030 was laminated on its two surfaces using a thermosetting polyester adhesive.

Figure 2:
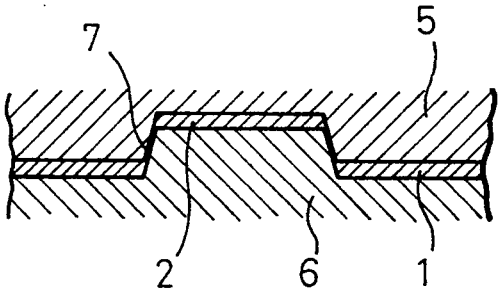
FIG. 2 is a longitudinal sectional view showing the steps of the process for working the present invention.

When making this sheet steel with polyester resin films on its two surfaces into the easy open can lid shown in FIG. 1, key portions of the lid body were pressed using upper and lower mold halves 5 and 6 corresponding to the opening piece in shape and dimensions, as shown in FIG. 2, thereby extruding upward the portion corresponding to the opening piece 2. At this time, the peripheral edge of the opening piece 2, the lid body 1, and the connecting piece 7 formed a thin portion which flared open downward at a slant and had a smooth change in thickness due to elongation.

Figure 3:
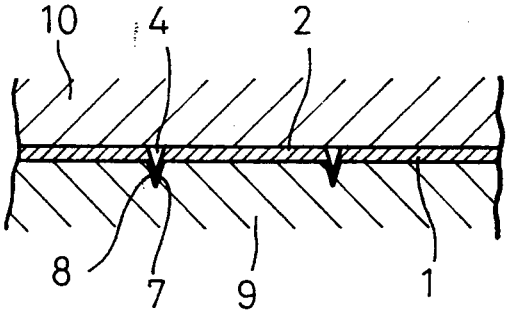
FIG. 3 is a longitudinal sectional view showing the steps of the process for working the present invention.

Next, as shown in FIG. 3, the lid body 1 was placed on a lower mold half 9, which had a groove 8 at a portion corresponding to the peripheral edge of the opening piece 2, so that the opening piece 2 came to the inside of the groove 8, and then the bottom surface was pressed by the smooth upper mold half 10.

By this operation, the connecting piece 7 having a smooth change in thickness was bent downward in a V-shape from the substantially intermediate portion and entered the groove 8. Therefore, a thin tear-along groove 4 having a V-sectional shape was formed at the peripheral edge of the opening piece 2 at the top surface of the lid body 1.

The easy open can lid thus shaped was evaluated as to the can openability by measurement of the tearing force required for the opening piece and was used for a conductance test studying the degree of destruction of the resin film at the inner and outer surfaces.

Table 1 shows the results. The lid was extremely superior in the can openability and the soundness of the resin film and satisfied the targets.

EXAMPLE 1-2

The same plated sheet steel as in Example 1-1 was laminated with polyester resin film on its two surfaces using two-layer construction polyester resin film comprised of films having different melting points and adhering the low melting point resin on the surfaces of the sheet steel by heat. At this time, the total thickness of the film used was 25 μm. The low melting point resin serving as the adhesion layer was a copolymer polyester resin having a thickness of 5 μm and a melting point of 225° C. As the upper layer, use was made of a copolymer polyester resin having a density of 1.370 g/cm$^3$, an orientation of 0.060, a thickness of 20 μm, and a melting point of 245° C.

Figure 4:
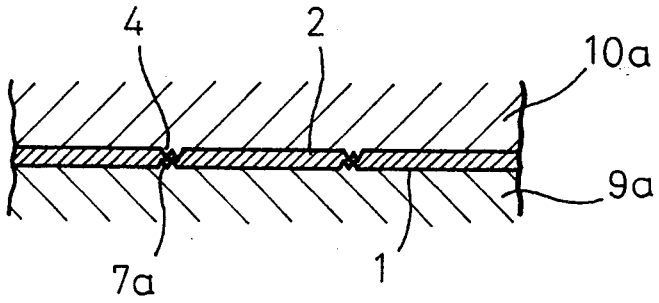
FIG. 4 is a longitudinal sectional view showing a different example of the pressing by upper and lower mold halves.

The sheet steel having the polyester resin film on its two surfaces was processed by a similar method as in Example 1—1 to form a thin portion which flared open downward at a slant and had a smooth change in thickness. After this, the upper mold half **10*a* and the lower mold half 9*a* with the smooth pressing surfaces shown in FIG. 4 were used to press the extruded sheet to the state of FIG. 2** and form the thin portion into the V-shaped wave.

The results of the evaluation of the performance of the lid formed are shown in Table 1. The lid was extremely superior in can openability and soundness of the resin films and satisfied the targets.

EXAMPLE 1-3

Figure 5A:
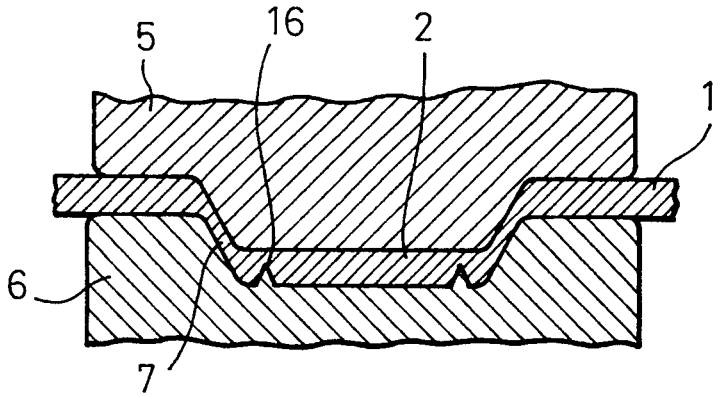
FIG. 5(*a*) is a longitudinal sectional view showing the state of forming a saucer shaped opening piece having a groove cut in at the peripheral edge of the lower surface thereof into a lid as a whole.

A sheet steel having non-oriented polyester resin films on the two sides of the surface-treated sheet steel, the same as in Example 1—1, was used to make an easy open can lid shown in FIG. 1. At that time, as shown in FIG. 5A, upper and lower mold halves 5 and 6 corresponding to the opening piece in shape and dimensions were used to press the key portions of the lid body, thereby extruding the portion corresponding to the opening piece 2 downward. At this time, the peripheral edge of the opening piece 2, the lid body 1, and the connecting piece 7 formed a thin portion which flared open upward at a slant and had a smooth change of thickness. At the same time, a cut-in groove 16 was provided at the peripheral edge of the lower surface and then the opening piece was pressed upward, thereby bending the thin portion having the smooth change in thickness upward in a V-shape (FIG. 5(*b*)) to form the tear-along groove. The existence of this cut-in groove 16 improved the can openability by formation of a remarkably thin portion between the tear-along groove 4 and the cut-in groove 16.

Table 1 shows the results of evaluation of the performance of the lid thus formed. The lid was extremely superior in both the can openability and the soundness of the resin film and satisfied the targets.

Comparative Example 1—1

Figure 6:
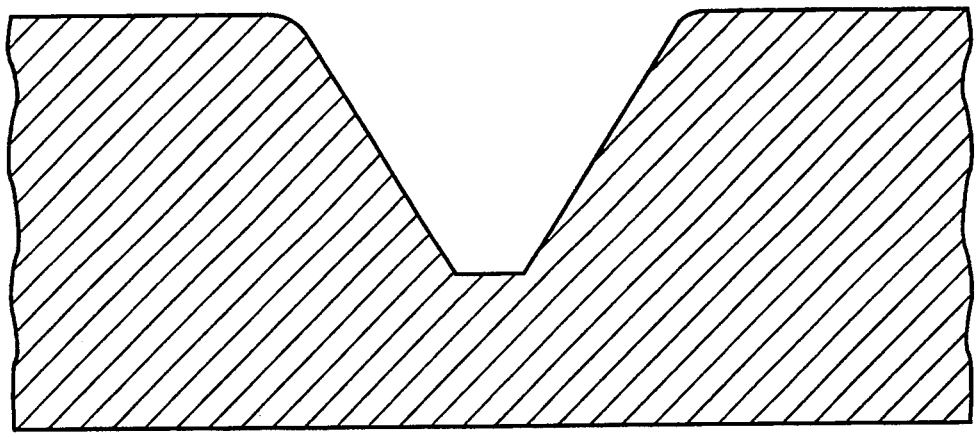
FIG. 6 PRIOR ART
FIG. 6 is a sectional view of a tear-along groove with a V-sectional shape by the conventional sharp blade pressing method.

A sheet steel having polyester resin film on its two surfaces, the same as in Example 1—1, was used to make an easy open lid as shown in FIG. 1. At this time, it was punched to the basic lid shape, then a sharp blade having a shape and dimensions corresponding to the shape and dimensions of the opening piece was pressed down to make the cutting edge bite into the lid body, thereby forming the shape of an opening piece surrounded by a tear-along groove with a V-sectional shape as shown in FIG. 6.

Table 1 shows the results of evaluation of the performance of the lid thus formed. The lid was substantially satisfactory in the can openability, but the resin film at the can outer surface where the shape blade was pressed was completely broken and required repair coating.

Comparative Example 1-2

An epoxy phenol thermosetting coating was applied twice to the two surfaces of the same plated sheet steel as in Example 1—1 to form films of a thickness of 13 μm. After this, the same processing method was used as in Example 1—1 to form the predetermined lid.

Table 1 shows the results of evaluation of the performance of the lid thus formed. The lid was substantially satisfactory in the can openability, but the resin films at the can inner and outer surfaces were broken and required repair coating.

TABLE 1

| Sample | Can openability (kg) | | Extent of damage of film* (mA/end) | |
|---|---|---|---|---|
| | Pop | Tear | Inner surface | Outer surface |
| Ex. 1-1 | 1.6 | 2.2 | 0.01 | 0.02 |
| Ex. 1-2 | 1.7 | 2.1 | 0.02 | 0.02 |
| Ex. 1-3 | 1.5 | 1.9 | 0.08 | 0.03 |
| Comp. Ex. 1-1 | 1.8 | 2.0 | 10.0 | >1000 |
| Comp. Ex. 1-2 | 1.7 | 2.0 | 25.0 | 20.0 |

*The extent of damage of the film is gauged using the magnitude of the current flowing when the formed lid is immersed in a 1% saline solution and a voltage of 6V is applied with a counter electrode.

EXAMPLE 2-1

The surface of a thin sheet steel having a thickness of 0.250 mm, a hardness ($H_{R30T}$) of 62 and an elongation of 25% was tin plated electrically to a deposition of 2.8 g/m$^2$. The tin was heated and melted to give a surface with a mirror gloss, then electrolytic after-treatment was performed in a treatment bath consisting mainly of chromic acid to form a chromate film of metal chrome of 10 mg/m$^2$ and, on the top of the same, chrome oxide hydrate of 13 mg/m$^2$ (as Cr). This was rinsed and dried, then the sheet steel was heated and a polyester resin film having a thickness of 20 μm having a glass transition temperature of 68° C., a crystalline melting point of 235° C., and a surface orientation of 0.105 was laminated on the both surfaces of the sheet steel by a laminating method so as to form a non-oriented structure (or an amorphous structure).

When making this sheet steel with polyester resin films on its two surfaces into the easy open can lid shown in FIG. 1, key portions of the lid body were pressed using upper and lower mold halves 5 and 6 corresponding to the opening piece in shape and dimensions, as shown in FIG. 2, thereby extruding upward the portion corresponding to the opening piece 2. At this time, the peripheral edge of the opening piece 2, the lid body 1, and the connecting piece 7 formed a thin portion which flared open downward at a slant and had a smooth change in thickness due to elongation. The thinnest thickness in this Example was 62 μm.

Next, as shown in FIG. 3, the lid body 1 was placed on a lower mold half 9, which had a groove 8 at a portion corresponding to the peripheral edge of the opening piece 2, so that the opening piece 2 came to the inside of the groove 8, and then the bottom surface was pressed by the smooth upper mold half 10.

By this operation, the connecting piece 7 having a smooth change in thickness was bent downward in a V-shape from the substantially intermediate portion and entered the groove 8. Therefore, a thin tear-along groove 4 having a V-sectional shape was formed at the peripheral edge of the opening piece 2 at the top surface of the lid body 1.

The easy open can lid thus shaped was evaluated as to the can opening ability by measurement of the tearing force required for the opening piece and was used for a conductance test studying the degree of destruction of the resin film at the inner and outer surfaces.

As a result, both the force for pulling up the tab and the force for tearing open the can were about 1.8 kg, and thus, a superior can openability was displayed. In a conductance test in a 1% saline solution, the result was 0.1 mA or less for both the can inner and outer surfaces, and therefore, the polyester resin film was completely sound and the target was satisfied.

EXAMPLE 2—2

The same plating as in Example 2-1 was performed on the surface of a sheet steel having a thickness of 0.190 mm, a hardness ($H_{R30T}$) of 56, and an elongation of 30%. This was rinsed and dried, then was laminated with a polyester resin film having a thickness of 40 μm on its two surfaces using two-layer construction polyester resin film having different melting points and glass transition temperatures. At this time, the lower layer of resin serving as the adhesion layer was a copolymer polyester resin having a thickness of 5 μm, a melting point of 215° C., and a glass transition temperature of 40° C., and the upper layer was one having a thickness of 20 μm, a melting point of 240° C. and a glass transition temperature of 65° C. The surface orientation was about 0.020.

When using this sheet steel to make an easy open can lid shown in FIG. 1, as shown in FIG. 5A, upper and lower mold halves 5 and 6 corresponding to the opening piece in shape and dimensions were used to press the key portions of the lid body, thereby extruding the portion corresponding to the opening piece 2 downward. At this time, the peripheral edge of the opening piece 2, the lid body 1, and the connecting piece 7 formed a thin portion which flared open upward at a slant and had a smooth change of thickness. At the same time, a cut-in groove 16 was provided at the peripheral edge of the lower surface and then the opening piece was pressed upward, thereby bending the thin portion having the smooth change in thickness upward in a V-shape (FIG. 5(*b*)) to form the tear-along groove. The existence of this cut-in groove 16 improved the can openability by formation of a remarkably thin portion between the tear-along groove 4 and the cut-in groove 16. The thickness of the thinnest portion in this embodiment was 58 μm.

A look at the performance of the shaped lid shows the can openability was a superior 1.7 kg, no conductance was observed in the resin film, which was extremely excellent, and the targets were therefore satisfied.

Comparative Example 2-1

The surface of a sheet steel having a thickness of 0.230 mm, a hardness ($H_{R30T}$) of 70, and an elongation of 8% was plated in the same way as in Example 2-1, then the same resin film as in Example 2-1 was laminated and the sheet was processed by the same processing method as in Example 2-1 to give a thinnest portion of 60 μm. Due to the insufficient elongation of the material, part of the tear-along groove was broken and a normal lid could not be shaped.

Comparative Example 2—2

The surface of a sheet steel of a thickness of 0.250 mm, a hardness ($H_{R30T}$) of 50, and an elongation of 40% was plated in the same way as in Example 2-1, then the same resin film as in Example 2-1 was laminated and the sheet was processed by the same processing method as in Example 2-1 to give a thinnest portion of 60 μm. The sheet was able to be processed with no problem at all, but when a 211 diameter (lid: 209 diameter) can was filled with a carbonated beverage, there was buckling of the can lid due to the insufficient lid strength.

Comparative Example 2–3

The same sheet steel as in Example 2-1 was plated in the same way as in Example 2-1, then was rinsed and dried, then the sheet steel was heated and polyester resin film having a thickness of 20 μm, a glass transition temperature of 40° C., a crystalline melting point of 220° C., and a surface orientation of 0.080 was laminated on the two surfaces of the sheet steel using a thermosetting polyester adhesive.

The sheet steel was shaped into a lid in the same way as in Example 2-1, whereby the resin was observed to build up at the projecting corner R portions of the lower mold half and upper mold half shown in FIG. 2, and therefore, necessitated frequent maintenance of the mold.

EXAMPLE 3-1

The two surfaces of sheet steel having a thickness of 0.255 mm, a hardness ($H_{R30T}$) of 64, and an elongation of 24% were nickel plated to a deposition of 0.58 g/m$^2$, then chromate treatment was performed to give 5 mg/m$^2$ of metal chrome and 12 mg/m$^2$ (as Cr) of chrome oxide hydrate. This was rinsed and dried, then the sheet steel was heated and polyester resin film having a thickness of 38 μm was laminated on the two surfaces of the sheet steel using a thermosetting polyester adhesive, so that the surface orientation becomes 0.060.

When making this sheet steel with polyester resin film on its two surfaces into the easy open can lid shown in FIG. 1, key portions of the lid body were pressed using upper and lower mold halves 5 and 6 corresponding to the opening piece in shape and dimensions, as shown in FIG. 2, thereby extruding upward the portion corresponding to the opening piece 2. At this time, the peripheral edge of the opening piece 2, the lid body 1, and the connecting piece 7 formed a thin portion which flared open downward at a slant and had a smooth change in thickness due to elongation. The thickness of the thinnest portion of the sheet steel at the connecting piece 7 was adjusted to 60 μm (1/4.25 of original sheet). The polyester resin film was processed in the same way as the sheet steel to leave a thickness at the surface of the thinnest portion of about 7 μm.

Next, as shown in FIG. 3, the lid body 1 was placed on a lower mold half 9, which had a groove 8 at a portion corresponding to the peripheral edge of the opening piece 2, so that the opening piece 2 came to the inside of the groove 8, and then the bottom surface was pressed by the smooth upper mold half 10.

By this operation, the connecting piece 7 having a smooth change in thickness was bent downward in a V-shape from the substantially intermediate portion and entered the groove 8. Therefore, a thin tear-along groove 4 having a V-sectional shape was formed at the peripheral edge of the opening piece 2 at the top surface of the lid body 1.

The easy open can lid thus shaped was evaluated as to the can openability by measurement of the tearing force required for the opening piece and was used for a conductance test studying the degree of destruction of the plastic film at the inner and outer surfaces. The can openability of the shaped product (force for lifting the tab and force for tearing the opening piece open) was a superior less than 2.0 kg, while the conductance of the resin film was 0.05 mA at the inner surface and 0.24 mA at the outer surface, which was able to fully satisfy the requirements of practical use. The impact strength was also of a level posing no problems.

EXAMPLE 3-2

The two surfaces of sheet steel having a thickness of 0.180 mm, a hardness ($H_{R30T}$) of 59, and an elongation of 26% was tin plated electrically to a deposition of 2.8 g/m$^2$. The tin was heated and melted to give a surface with a mirror gloss, then electrolytic after-treatment was performed in a treatment bath consisting mainly of chromic acid to form a chromate film of metal chrome of 10 mg/m$^2$ and, on the top of the same, chrome oxide hydrate of 12 mg/m$^2$ (as Cr). This was rinsed and dried, then the sheet steel was heated and a polyester resin film of a surface orientation of 0.080 and a thickness of 20 μm was laminated in the two surfaces of the sheet steel using a thermosetting epoxy adhesive.

Figure 5B:
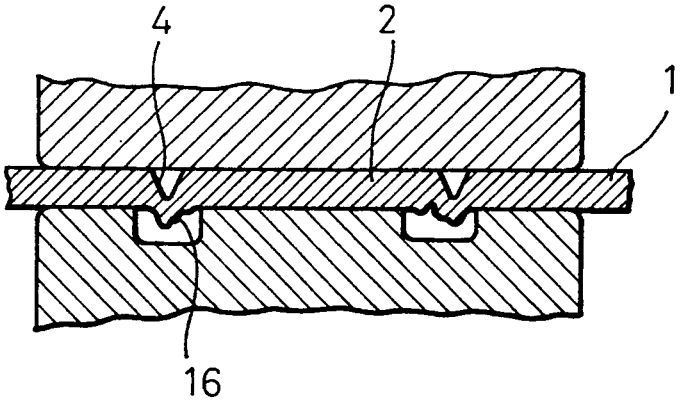

When using this sheet steel with a polyester resin film on its two surfaces into the easy open can lid shown in FIG. 1, the portion corresponding to the opening piece 2 was extruded downward using upper and lower mold halves 5 and 6 corresponding to the opening piece in shape and dimensions, as shown in FIG. 5(*a*). At this time, the peripheral edge of the opening piece 2, the lid body 1, and the connecting piece 7 formed a thin portion which flared open upward at a slant and had a smooth change in thickness due to elongation. At the same time, a cut-in groove 16 was provided at the peripheral edge of the lower surface and then the opening piece was pressed upward, thereby bending the thin portion having the smooth change in thickness upward in a V-shape (FIG. 5(*b*)) to form the tear-along groove.

The existence of this cut-in groove 16 improved the can openability by formation of a remarkably thin portion between the tear-along groove 4 and the cut-in groove 16. The thickness of the thinnest portion of the sheet steel was adjusted to 45 μm (1/4.0 of original sheet). The polyester film was shaped in the same way as the sheet steel and remained in a thickness of about 5 μm at the surface of the thinnest portion.

The easy open can lid shaped in this way was used for tests on the can openability, impact resistance, and destruction of the inner and outer surface resin films by the same methods as in Example 3-1. The can opening ability was less than 1.7 kg, allowing the can to be opened with no problem. The conductance of the resin film was 0.8 mA at the inner surface and 2.4 mA at the outer surface, fully sufficient for practical use.

Comparative Example 3-1

The same polyester resin film laminated sheet steel as in Example 3-1 was used and was processed by the same processing method as in Example 3-1 to give thickness of the thinnest portion of the sheet steel of 20 μm (1/12.8 of original sheet). The polyester resin films were processed in the same way as the sheet steel and remained at the surface of the thinnest portion in a thickness of about 2.3 μm.

As a result of the tests evaluating the performance, the can openability was found to be a superior 1.2 kg and the conductances of the resin film were found to be 65 mA at the inner surface and 80 mA at the outer surface.

The lid was insufficient in the impact resistance in the dropping test after filling the can, and therefore, there was a problem in practical use.

Comparative Example 3-2

A polyester resin film laminated sheet steel having a thickness of 16 μm was prepared by the same method as in Example 3-1. Then, the same processing method as in Example 3-1 was used to obtain a thickness of the thinnest portion of the sheet steel of 55 μm (1/4.6 of original sheet). The polyester resin film was shaped in the same way as the sheet steel and remained at the surface of the thinnest portion in a thickness of about 3.5 μm.

As a result of the tests evaluating the performance, the can opening ability was found to be a superior 1.9 kg and the impact resistance after filling of the can was of a level posing no problems, but the conductances of the resin film were found to be 28 mA at the inner surface and 45 mA at the outer surface, and therefore, it was judged that there were considerable defects in the films and the sheet could not be practically used.

Comparative Example 3-3

The same a polyester resin film laminated sheet steel the same as Example 3-2 was used and processed in the same manner as in Example 3-2 to obtain a thickness of the thinnest portion of the sheet steel of 95 μm (1/1.9 of original sheet). The polyester resin film was shaped in the same way as the sheet steel and remained at the surface of the thinnest portion in a thickness of about 10.5 μm.

As a result of the tests evaluating the performance, the conductance of the resin film was found to be 0 mA at both the inner and outer surfaces, and therefore, no film defects were observed, but as a result of the can opening test, the force required was of a level not enabling the can to be opened by the hand.

EXAMPLE 4-1

The surface of a thin sheet steel having a thickness of 0.260 mm and a hardness ($H_{R30T}$) of 63 was tin plated electrically to an amount of deposition of 1.1 g/m$^2$. The tin was heated and melted to give a surface with a mirror gloss, then electrolytic after-treatment was performed in a treatment bath consisting mainly of chromic acid to form a chromate film of metal chrome of 8 mg/m$^2$ and, on the top of the same, chrome oxide hydrate of 12 mg/m$^2$ (as Cr). This was rinsed and dried, then the sheet steel was heated and a biaxially oriented polypropylene resin film of a thickness of 50 μm was laminated on the two surfaces of the sheet steel using a modified polypropylenepolyethylene copolymer film as the adhesive. The biaxially oriented polypropylene resin film used had an elongation of 90% and a tensile modulus of 260 kg/mm$^2$.

When making this sheet steel with a biaxially oriented polypropylene resin film on its two surfaces into the easy open can lid shown in FIG. 1, key portions of the lid body were pressed using upper and lower mold halves 5 and 6 corresponding to the opening piece in shape and dimensions, as shown in FIG. 2, thereby extruding upward the portion corresponding to the opening piece 2. At this time, the peripheral edge of the opening piece 2, the lid body 1, and the connecting piece 7 formed a thin portion which flared open downward at a slant and had a smooth change in thickness due to elongation. Next, as shown in FIG. 3, the lid body 1 was placed on a lower mold half 9, which had a groove 8 at a portion corresponding to the peripheral edge of the opening piece 2, so that the opening piece 2 came to the inside of the groove 8, and then the bottom surface was pressed by the smooth upper mold half 10.

By this operation, the connecting piece 7 having a smooth change in thickness was bent downward in a V-shape from the substantially intermediate portion and entered the groove 8. Therefore, a thin tear-along groove 4 having a V-sectional shape was formed at the peripheral edge of the opening piece 2 at the top surface of the lid body 1.

The easy open can lid thus shaped was evaluated as to the can opening ability by measurement of the tearing force required for the opening piece and was used for a conductance test studying the degree of destruction of the plastic film at the inner and outer surfaces. The can openability of the shaped product (force for lifting the tab and force for tearing the opening piece open) was a superior less than 2.0 kg, while the conductance of the resin film was about 0.3 mA, a superior soundness, and therefore the targets were satisfied. Further, no feathering noticeable to the naked eye was observed around the cut of the torn tear-along groove.

EXAMPLE 4-2

The same plated sheet steel as in Example 4-1 was laminated with polyester resin films on its two surfaces using a two-layer construction polyester resin film comprised of films having different melting points and adhering the low melting point resin on the surfaces of the sheet steel by heat. At this time, the total thickness of the film used was 35 μm. The upper layer polyester film having a drawn orientation was one with an elongation of 240% and a tensile modulus of 400 kg/mm$^2$.

When using the sheet steel having polyester resin films on its two sides to make an easy open can lid shown in FIG. 1 upper and lower mold halves 5 and 6 corresponding to the opening piece in shape and dimensions were used to extrude downward the portion corresponding to the opening piece 2, as shown in FIG. 5(*a*). At this time, the peripheral edge of the opening piece 2, the lid body 1, and the connecting piece 7 formed a thin portion which flared open upward at a slant and had a smooth change of thickness. At the same time, a cut-in groove 16 was provided at the peripheral edge of the lower surface and then the opening piece was pressed upward, thereby bending the thin portion having the smooth change in thickness upward in a V-shape (FIG. 5(*b*)) to form the tear-along groove. The existence of this cut-in groove 16 improved the can openability by formation of a remarkably thin portion between the tear-along groove 4 and the cut-in groove 16. The thickness of the thinnest portion of the sheet steel was adjusted to 60 μm. The polyester films were shaped in the same way as the sheet steel and remained in a thickness of about 6 μm at the surface of the thinnest portion.

The can openability of the shaped product was 1.8 kg or less allowing the can to be opened with no problem. The conductance of the resin film was 0.8 mA at the inner surface and 0.9 mA at the outer surface, fully sufficient for practical use. Further, no feathering noticeable to the naked eye was observed around the broken tear-along groove.

EXAMPLE 4-3

The two sides of a sheet steel having a thickness of 0.180 mm, a hardness ($H_{R30T}$) of 64, and an elongation of 24% were plated with nickel to a deposition of 0.58 g/m$^2$, then were subjected to chromate treatment using 5 mg/m$^2$ of metal chrome and 12 mg/m$^2$ of chrome oxide hydrate (as Cr). This was rinsed and dried, then the sheet steel was heated and was laminated with non-oriented nylon film of 40 μm using a thermosetting epoxy adhesive. The nylon film was one with an elongation of 350% and a tensile modulus of 90 kg/mm$^2$.

The two surfaces of the sheet steel having the biaxially oriented nylon resin film were processed by a processing method similar to that of Example 2 so that the thickness of the sheet steel at the thinnest portion became 50 μm. A plastic film was formed in the same way on the sheet steel and the thickness of the film remaining at the surface at the thinnest portion was about 11 μm.

Regarding the can openability of the product formed, the can was opened without problem with 1.6 kg or less force and the conductance value of the plastic film was sufficiently satisfactory for practical use, being 0.1 mA at the inner surface and 0.08 mA at the outer surface. Further, no noticeable feathering could be observed by the naked eye at the periphery of the cut of the torn tear-along groove.

Comparative Example 4-1

An undrawn polypropylene resin film having a thickness of 50 μm was laminated on the two surfaces of the same plated sheet steel as in Example 4-1 using modified polypropylene-polyethylene copolymer resin as an adhesive. The undrawn polypropylene resin film used was one with an elongation of 470% and a tensile modulus of 50 kg/mm$^2$.

Using this sheet steel as a material, an easy open can lid was prepared using a method similar to that of Example 4-1 to give a thin tear-along groove forming a V-sectional shape. When pressing the key portions of the can body using upper and lower mold halves corresponding to the opening piece in shape and dimensions, the plastic film was shaved off at the mold corner R portions and build-up of resin was observed.

The can openability of the formed product (force for popping the tab and force for tearing off the opening piece) was a superior 2.0 kg or less. The conductance of the resin film was about 1.5 mA, which was judged to be practical in terms of the corrosion resistance, but there was much residual film at the periphery of the cut of the tear-along groove broken at the time of opening, which gave an unpleasant feeling in terms of external appearance and so there were problems remaining in practical application.

Comparative Example 4-2

Polystyrene film having a thickness of 40 μm was laminated on the same plated sheet steel as in Example 4-1 using a thermosetting epoxy adhesive. The film was one with an elongation at break of 40% and a tensile modulus of 120 kg/mm$^2$. The sheet steel was processed by the same method as in Example 4-2, whereupon the conductance value of the resin film became an extremely large value of 540 mA, numerous defects were observed in the resin film inside the tear-along groove, and thus the result was of no practical use.

We claim:

1. A sheet steel easy open can lid containing an opening piece not requiring repair coating of the inner and outer surfaces, wherein a resin-laminated sheet steel, having resin laminated on inner and outer surfaces, is used as a substrate a tear-along groove at the peripheral edge of the opening piece is formed, without cutting the laminated resin sheet on the inner and outer surfaces, by composite cold-forming.

2. A sheet steel easy open can lid containing an opening piece not requiring repair coating of the inner and outer surfaces as claimed in claim 1, wherein said resin-laminated steel sheet has a thickness prior to cold forming and wherein after cold forming, the thickness of the thinnest portion is ½ or less of the thickness prior to cold forming.

3. A sheet steel easy open can lid containing an opening piece not requiring repair coating of the inner and outer surfaces as claimed in claim 1, wherein the resin film of the resin-laminated sheet steel has an elongation at break of at least 50% and a tensile modulus of at least 60 kg/mm$^2$.

4. A sheet steel easy open can lid not requiring repair coating of the inner and outer surfaces as claimed in claim 1, wherein the thickness ($t_{min}$) of the thinnest portion of the tear-along groove is within the range satisfying the relationship of:

$$t_0/10 \leqq t_{min} \leqq t_0/2$$

where $t_{min}$: thinnest thickness inside tear-along groove, and to: thickness of sheet steel of 0.1500–0.300 mm, and $$4.0 \leqq f_0 \times (t_{min}/t_0)$$

where $f_0$: an initial resin thickness of 10–80 μm, and the coating film on the both surfaces of the resin-laminated sheet steel is derived from a polyester resin having a surface orientation of 0.160 or less.

5. A sheet steel easy open can lid containing an opening piece not requiring repair coating of the inner and outer surfaces as claimed in claim 1, wherein the resin-laminated sheet steel comprises a sheet steel having, thereon in the order of (a) a plating layer of at least one metal selected from the group consisting of Sn, Cr, Ni, Al, and Zn, (b) a chromate coating, and (c) a polyester resin coating having a surface orientation of 0.160 or less.

6. A sheet steel easy open can lid containing an opening piece not requiring repair coating of the inner and outer surfaces as claimed in claim 1, wherein the sheet steel of the resin-laminated sheet steel has a hardness ($H_{R30T}$) of 54 to 68 and an elongation of 10 to 40%.

7. A sheet steel easy open can lid containing an opening piece not requiring repair coating of the inner and outer surfaces as claimed in claim 1, wherein the resin laminated on the both surfaces of the resin-laminated sheet steel is a polyester resin having a glass transition temperature of at least 50° C., a crystalline melting point of at least 210° C., and a surface orientation of 0.160 or less.

8. A sheet steel easy open can lid containing an opening piece not requiring repair coating of the inner and outer surfaces as claimed in claim 7, wherein a polyester resin layer having a glass transition temperature of 50° C. or less is provided under the laminated resin film of the resin-laminated sheet steel.

* * * * *

UNITED STATES PATENT AND TRADEMARK OFFICE

CERTIFICATE OF CORRECTION

PATENT NO. : 5,348,809

DATED : September 20, 1994

INVENTOR(S) : Yashichi OYAGI, et al.

It is certified that error appears in the above-indentified patent and that said Letters Patent is hereby corrected as shown below:

Column 4, line 18, between "groove" and "composite" insert --by--.

Column 8, line 16, change "shade" to --shape--.

Column 8, line 27, delete "obtained" and insert --to obtain--.

Column 11, line 12, change "two surface" to --two surfaces--.

Column 20, line 31, change "substrate a tear-along" to --substrate and a tear-along--.

Column 20, line 57, change "to" to --$t_0$-- and "0.1500" to --0.150--.

Signed and Sealed this

Fourteenth Day of February, 1995

*Attest:*

*Attesting Officer*

BRUCE LEHMAN

*Commissioner of Patents and Trademarks*